US006357202B1

(12) United States Patent
Bauer et al.

(10) Patent No.: US 6,357,202 B1
(45) Date of Patent: Mar. 19, 2002

(54) DEVICE FOR SUPPLYING PACKAGE SLEEVES TO A FILLING MACHINE FOR FILLING LIQUID FOODSTUFFS INTO MULTI-LAYER COMPOSITE PACKAGES

(75) Inventors: Jens Bauer, Langebruck; Jorg Berger, Aachen; Thomas Bohme, Dresden; Franz-Willi Spelten, Wegberg, all of (DE)

(73) Assignee: SIG Combibloc GmbH, Linnich (DE)

( * ) Notice: Subject to any disclaimer, the term of this patent is extended or adjusted under 35 U.S.C. 154(b) by 0 days.

(21) Appl. No.: 09/297,338

(22) PCT Filed: Nov. 3, 1997

(86) PCT No.: PCT/EP97/06062

§ 371 Date: Aug. 4, 1999

§ 102(e) Date: Aug. 4, 1999

(87) PCT Pub. No.: WO98/19914

PCT Pub. Date: May 14, 1998

(30) Foreign Application Priority Data

Nov. 5, 1996 (DE) ..... 196 45 594

(51) Int. Cl.[7] ..... B65B 7/28

(52) U.S. Cl. ..... 53/295; 53/202; 53/585

(58) Field of Search ..... 53/290, 291, 295, 53/202, 585; 414/795.8, 797.8, 744.4, 751.1, 744.2; 294/86.41, 103.1

(56) References Cited

U.S. PATENT DOCUMENTS 3,964,619 A * 6/1976 Irmler ..... 214/16 B
5,391,050 A * 2/1995 Gatteschi ..... 414/796

FOREIGN PATENT DOCUMENTS

DE 4024451 A1 2/1991
DE 4142167 C2 9/1993
GB 2 203 723 * 4/1988 ..... B25J/5/04
GP 4024451 * 2/1991 ..... B65B/41/00

* cited by examiner

*Primary Examiner*—Peter Vo
*Assistant Examiner*—Hemant M. Desai
(74) *Attorney, Agent, or Firm*—Standley & Gilcrest LLP

(57) ABSTRACT

A device capable of transporting package sleeves in an upright position, from any of several filling lines to one or more filling machines, wherein said several filling lines are aligned parallel to each other. The device utilizes a manipulator capable of linear travel in a direction perpendicular to the plane of alignment of the filling lines, a swiveling unit for moving the package sleeves in a direction transverse to the direction of travel of the manipulator unit, and a gripper unit for gripping the package sleeves. The gripper unit is capable of supplying horizontal force to the package sleeves to enable their transport in an upright position. The gripper unit also has means to clamp to the loading magazine of the filling machine and to cause the horizontal transfer of the package sleeves thereto. By use of the present device, semi-automatic or automatic loading of package sleeves to one or more filling machines is possible.

12 Claims, 3 Drawing Sheets

DEVICE FOR SUPPLYING PACKAGE SLEEVES TO A FILLING MACHINE FOR FILLING LIQUID FOODSTUFFS INTO MULTI-LAYER COMPOSITE PACKAGES

BACKGROUND AND SUMMARY OF THE INVENTION

The invention concerns a device for supplying package sleeves to a filling machine for filling liquid foodstuffs into multi-layer composite packages, with the filling machine comprising several filling lines aligned parallel to each other.

Multi-layer composite packages, in particular cuboid multi-layer packages are generally known in particular as units of sales for drinks. Thanks to their favourable energy balance, they are increasingly competing successfully against drink bottles, including returnable drink bottles. Of these cuboid multi-layer composite packages, some are made from a tube and are separated only after packaging; others are made from package cutouts comprising folding grooves, and glued together to a package sleeve. With these, manufacture of the completed package bottom only takes place immediately prior to filling.

Filling machines for filling liquid foodstuffs into such multi-layer composite packages are known from German patent DE 41 42 167 C2. These known filling machines comprise a number of magazines for supplying the package sleeves, corresponding to the number of filling lines. Since as a rule, these filling machines are located at the filling enterprise, the pre-fabricated package sleeves, with printing according to the specifications of the filling enterprise, are first of all packed at the manufacturer's premises where a specified number of flat, folded package sleeves are stacked in a parcel which is held together by a carton as outer packaging, for transport to the filling enterprise. It is self-evident that with this type of transport, the available transport volume can be utilised almost to one hundred percent. In this, the individual cartons containing the package-sleeve parcels are stacked on Europallets in order to facilitate or speed up loading and unloading of the trucks.

With the known filling machine it is necessary to free the depalletised parcels of package sleeves, still in cartons, from their outer packaging and supply them by the parcel to the magazine or the magazines of the filling machine. Since filling regularly takes place at high speed, care must always be taken that the magazines have an adequate supply of package sleeves, to reliably prevent the filling machine from stopping. This necessitates continuous attendance of an operator.

From GB 2 203 723 A a transport system for packaging blanks is known where the packaging blanks stacked one on top of the other are placed from a storage area onto a conveyor belt. To this effect, the conveyor system provides for a gripper device which is moveable perpendicular to the conveyor belt on a connecting piece. The two ends of this connecting piece are connected to two rails which enable lateral movement of the connecting piece along the conveyor belt.

EP 0 597 549 A1 describes a particular embodiment of a gripper for conveying packaging blanks, which makes possible the removal of a number of stacked packaging blanks from a larger stack of stacked packaging blanks. To this effect, the desired number of packaging blanks is laterally displaced in the upper part of the stack and subsequently taken up by the gripper.

The known conveyor systems only have limited application for the use in filling machines for filling liquid foodstuffs. Firstly, with the known conveyor system it is impossible to convey package sleeves in an upright position, and secondly their design volume is either too large or they are unnecessarily complex for gripping package sleeves in an upright position.

It is thus the object of the present invention to create a device for supplying package sleeves in an upright position into such a filling machine for filling liquid foodstuffs into multi-layer composite packages, which takes some of the load off the operator and reliably ensures semi-automatic or even fully-automatic supply of package sleeve parcels.

According to the invention, this object is met by a manipulator with a gripper unit for gripping one parcel of upright package sleeves at a time, and for handing it over to a defined filling line. In this, the gripper unit is able, in the horizontal plane, to travel parallel and across the filling lines and comprises means for clamping and handing over the parcels. According to the invention, the parcels now no longer need to be supplied to the individual magazines of the different filling lines but only to the manipulator which, depending on the actual fill state of the magazines, handles distribution of the parcels to the respective magazines with the lowest fill levels. As a result of its ability to travel in the horizontal plane and to swivel across it, the gripper unit is suitable for fast processing.

A further disclosure of the invention provides for the manipulator to comprise a drive unit which on at least one rail is able to travel longitudinally, parallel to the filling lines. In addition, it is useful if the manipulator comprises a swivelling unit which can be swivelled in the horizontal plane in relation to the above-mentioned drive unit. In this way, during supply of the magazines of the individual fill lines, lateral swivelling of the parcels can take place in order to supply the parcel held at a given time by the manipulator, to the respective magazine.

A further embodiment of the invention provides that, as a means for gripping on the side of the filling machine, at least two swing-out clamping plates are provided which press the lateral front edges of a parcel against a pressure ram engaging the other end of the parcel. This reliably ensures that the next compressible parcel is compressed to such an extent that it can be reliably handled by the manipulator.

During the actual filling of the magazines care must be taken that package sleeves at the front of the parcel, or the last package sleeves of the magazines respectively, do not fall over as this would necessitate manual interference or in an extreme case would even result in the filling machine stopping. For this reason [to ensure safe hand-over of the parcel] in a further preferred embodiment of the invention, the pressure ram is able to travel longitudinally in relation to the swiveling unit of the manipulator, in the direction of the filling lines. This reliably ensures that with the manipulator idle, the parcel handed over to the magazine is moved on by the pressure ram, at the feed speed of the package sleeves supplied to the filling machine, until its arrival in the magazine of the filling machine is completed and the "fall-over safeguard" of the last package sleeves has been taken over by the magazine.

From a construction point of view it is particularly advantageous if, according to a further disclosure of the invention, the clamping plates and the pressure ram are immediately coupled to the swivelling unit. In order to achieve the ability for lateral swivelling, a further preferred embodiment of the invention provides for the swivelling unit to be coupled to the drive unit and moveable in parallel, by means of two swivel arms arranged one behind the other in the direction of supply. In this it is advantageous if only one of the swivel arms is driven and the other swivel arm is force-coupled to the said rotationally-driven first swivel arm. This reliably prevents occurrence of a malfunction from the starting movement in the dead centre, in regard to parallel alignment of the swivelling unit. In this, known construction elements such as chains, belts or similar may be used as a forced coupling.

In order to enable the device according to the invention to operate for as long a period as possible, without supervision by operating personnel, a further embodiment of the invention provides for a storage area for holding a plural number of parcels to be additionally connected to the device. In this, it is particularly advantageous if the storage device comprises a number of storage areas corresponding to the respective number of filling lines; each of the said storage areas can accommodate a plural number of package-sleeve parcels. It is particularly advantageous if these storage areas extend vertically so that the parcels to be handed over can be handed over from below to the manipulator located in the plane of the filling line. It is useful if the storage areas comprise a plural number of travelling storage units for accommodating the parcels.

Finally, further embodiments of the invention provide for a device for depalletising to be additionally connected to the device, and/or that the device comprises means for removing the outer carton of a package-sleeve parcel. In this way, depending on the requirements and the layout of the locality of the filling enterprise, modular construction is possible for operating the device fully automatically or semi-automatically.

BRIEF DESCRIPTION OF THE DRAWINGS

Below, the invention is illustrated in more detail by means of a drawing showing only one preferred embodiment, as follows.

DETAILED DESCRIPTION OF THE PREFERRED EMBODIMENT(S)

Figure 1:
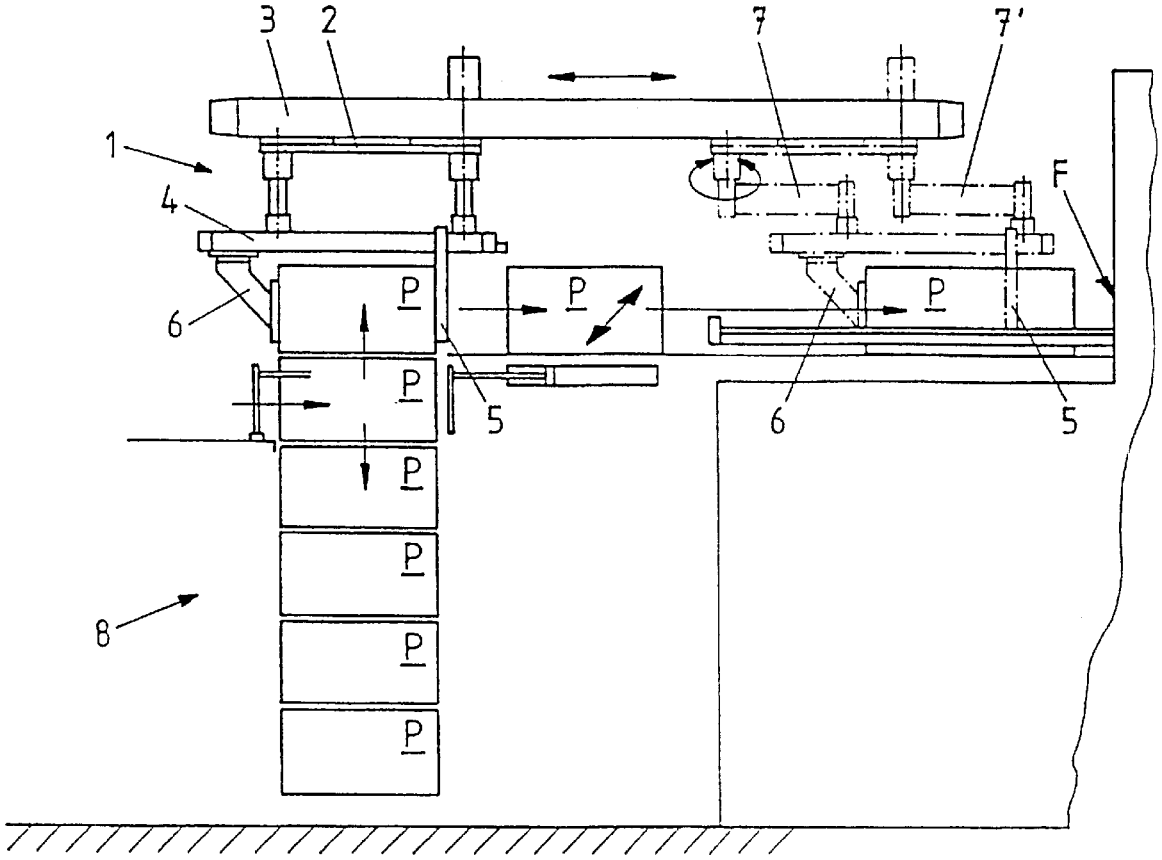
FIG. 1 shows a lateral view of the device according to the invention.
Figure 2:
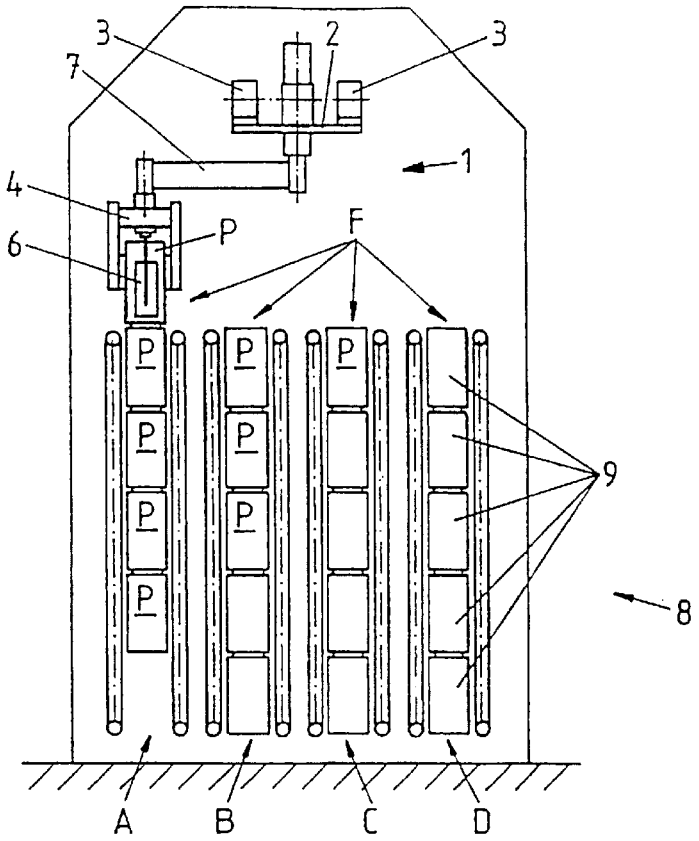
FIG. 2 shows a frontal view of the device according to the invention.

FIGS. 1 and 2 show two views of a preferred embodiment of the present invention. In this, the device according to the invention comprises a manipulator 1, essentially comprising a drive unit 2 travelling on rails 3 aligned parallel to the filling lines F of the filling machine (only implied), and a swivelling unit 4. In the embodiment shown, the filling machine comprises four filling lines F.

Figure 3:
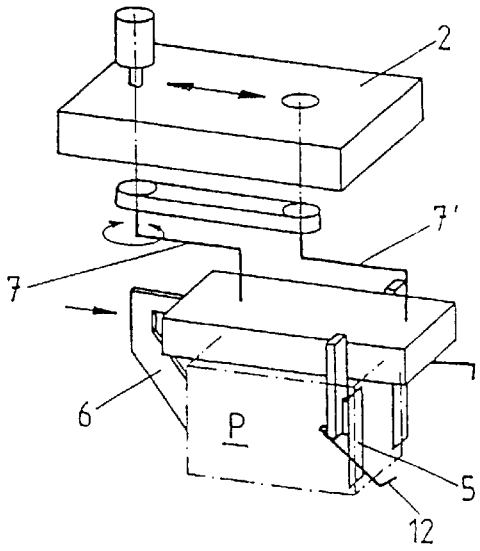
FIG. 3 shows a diagrammatic, three-dimensional representation of the device according to the invention.

FIG. 3 clearly shows the structure of the actual manipulator 1. The double arrows used diagrammatically represent the movements of drive unit 2 and swivelling unit 4. In this, the exact position of the manipulator 1 is determined by distance measuring devices (only implied), and reported to the microprocessor controlling supply. As a means for gripping a parcel P, on the side of the filling machine, the swivelling unit 4 comprises two swing-out clamping plates 5 which press the lateral front edges of the parcel P against a pressure ram 6 engaging the other end of the parcel P. As is suggested by an arrow, this pressure ram 6 is constructed in such a way as to be able to travel longitudinally, in the direction of the filling line F, relative to the swivelling unit 4 of the manipulator 1.

In order to achieve the ability of the swivelling unit 4 to swivel laterally in relation to the drive unit 2, in the preferred embodiment as shown, two swivel arms 7 and 7' provided, arranged one behind the other in the direction of supply. In this, rotation of the swivel arm 7 is directly by a torque motor (not shown in detail). To avoid problems concerning rotation from the dead centre position or over the dead centre position, both swivel arms 7 and 7' are force-coupled by a transmission means (not shown in detail). This ensures reliable parallel swivelling of the swivelling unit 4.

FIGS. 1 and 2 further show that a storage device 8 for storing a plural number of parcels P is additionally connected to the device according to the invention. It is useful if the storage device 8 comprises vertically extending storage areas A, B, C, D each of which can hold a plural number of package sleeve parcels P. In this, each storage area A, B, C, D comprises stacked storage units 9, so that the parcels P located there can be supplied from below to the manipulator 1. It is readily evident that by additionally connecting a storage device 8, extended operation of the filling machine becomes possible, without the need for an operator having to constantly place parcels P into the magazine M of the filling machine. Thus, for extended periods of time the operator is available for other tasks.

Figure 4:
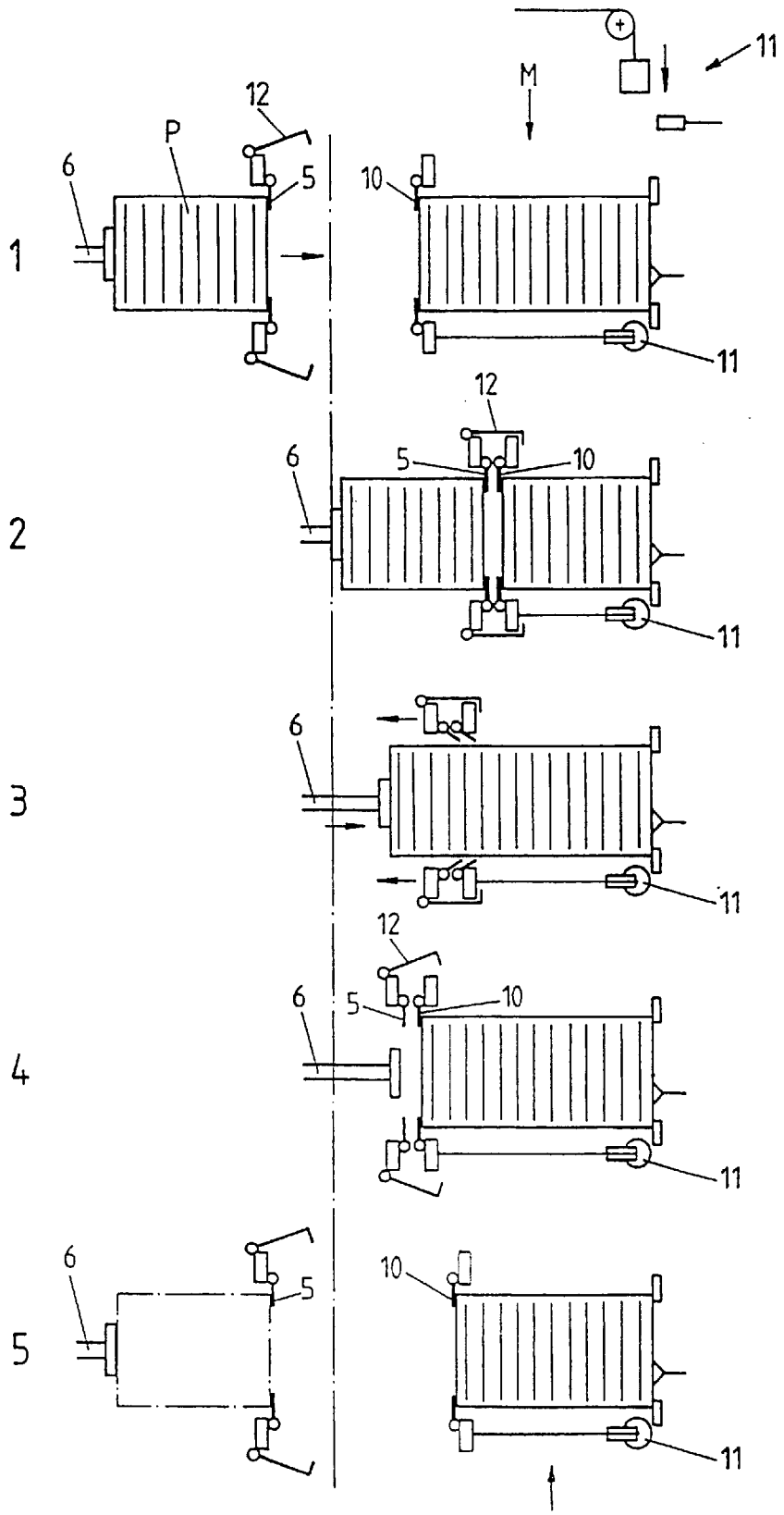
FIG. 4 shows the actual process of handing-over a package sleeve parcel, represented in individual steps.

FIG. 4 diagrammatically represents the actual process of handing-over a parcel P carried by the manipulator 1, shown in consecutive steps.

Five consecutive steps are shown representing a diagrammatical top view onto the parcel P carried by the manipulator 1 and the respective magazine M of the filling machine. For the sake of clarity, only one filling line is shown.

In the first step the parcel P is held by the clamping plates 5 on the swivelling unit (not shown) and the pressure ram 6. Supply occurs in the direction of the arrow to the magazine M of the filling machine. While a fixed end stop is provided at the magazine M of the filling machine, on the right, the last package sleeves (on the left) are secured against falling over by clamping plates 10 which form part of magazine M. Since on the right, a steady withdrawal of package sleeves occurs, the clamping plates 10 move to the right according to the speed of withdrawal. A distance measuring device 11, shown diagrammatically only, indicates when a predefined minimum fill level of the magazine M is reached. This regulated quantity is processed by a microprocessor, ensuring that the swivelling unit travels up to the magazine M with the parcel P placed into the holders, as is shown in step two. In this position, the two pairs of clamping plates 5, 10 are locked by locking stays 12 (shown diagrammatically only), and the clamping plates 5, 10 are swivelled out of the range of the package sleeves, as shown in step 3. In this, the pressure ram 6 takes care of the required moving up of the package sleeves into the magazine M. As mentioned already, for this purpose the pressure ram 6 has been designed so as to be able to travel longitudinally in relation to the swivelling unit 4 of the manipulator 1.

Step 3 further shows that, after the pressure ram 6 takes care of onward transport of the refilled package sleeves, the drive unit 2 is moved back sufficiently far for the pairs of clamping plates 5, 10 to come to a halt in the outermost (left) position of the magazine M. This position is shown in step 4. There the clamping plates 10 are swivelled into the cross-section of the package sleeve again and provide rear support for the package sleeves located in magazine M, as can be clearly seen in step 4. As a result, the pressure ram 6 is relieved and the clamping plates 5 are unlocked by the clamping plates 10 so that the entire swivelling unit 4 can be moved on for taking up the next parcel P from the magazine M.

The distance measuring devices 11 which are present for each magazine of the filling lines present, in conjunction with a respectively programmed microprocessor, ensure that the magazine with the lowest fill level is always supplied with the next package-sleeve parcel P, made available by the manipulator 1.

What is claimed is:

1. A loading device for supplying package sleeves to a filling machine for filling liquid foodstuffs into multi-layer composite packages, wherein said filling machine has several filling lines aligned parallel to each other, said loading device comprising:

a linearly traveling drive unit;

a swiveling unit movably attached to said drive unit; and a gripper unit attached to said swiveling unit, said gripper unit adapted to grip one parcel of upright package sleeves at a time;

wherein said drive unit travels in a plane horizontal with respect to the ground, and in a direction parallel to the length of said several filling lines; and wherein said swiveling unit allows a parcel held by said gripper unit to be transported to a position aside the line of travel of said drive unit;

wherein said loading device further comprising a clamping device located on each of side said filling lines for clamping said parcel placed therein by said gripper unit.

2. A loading device according to claim 1, wherein said swiveling unit is coupled to said drive unit by means of at least two swivel arms, said swivel arms moveable in parallel, and arranged one behind the other in a direction parallel to the length of said several filling lines.

3. A loading device according to claim 2, wherein one of said swivel arms is driven and the remainder of said swivel arms is force-coupled to said driven swivel arm.

4. A loading device according to claim 1, wherein said gripper unit further comprises:

at least two swing-out clamping plates, provided at the end of said gripper unit nearer said filling lines; and a pressure ram located on the opposite end of said gripper unit, said pressure ram for engaging one side of said parcel;

wherein said at least two swing-out clamping plates are adapted to engage with the side of said parcel opposite that of said pressure ram, thereby pressing said parcel against said pressure ram.

5. A loading device according to claim 4, wherein said pressure ram is adapted to travel, independently of said swiveling unit, in a direction parallel to the length of said several filling lines.

6. A loading device according to claim 4, wherein said at least two swing-out clamping plates and said pressure ram are coupled to said swiveling unit.

7. A loading device according to claim 1, further comprising a separate storage device for holding a plurality of parcels, certain of said parcels of said storage device accessible by said gripper unit.

8. A loading device according to claim 7, wherein said storage device comprises a multitude of individual storage compartments, at least one storage compartment corresponding to each of said filling lines, each of said storage compartments able to accommodate a plurality of parcels.

9. A loading device according to claim 8, wherein said storage compartments extend in a vertical direction with respect to the ground.

10. A loading device according to claim 8, wherein said storage compartments are comprised of a plurality of traveling, individual storage units, said storage units traveling in a vertical direction with respect to the ground in order to accommodate said parcels.

11. A loading device according to claim 1, further comprising a depalletizing device.

12. A loading device according to claim 1, further comprising a means for removing an outer carton portion of said parcel.

* * * * *

UNITED STATES PATENT AND TRADEMARK OFFICE

CERTIFICATE OF CORRECTION

PATENT NO. : 6,357,202 B1
DATED : March 19, 2002
INVENTOR(S) : Bauer et al.

It is certified that error appears in the above-identified patent and that said Letters Patent is hereby corrected as shown below:

Column 4,
Line 6, after "arms 7 and 7", please insert -- are --.

Column 5,
Line 2, please delete "unlocked by" and replace it with -- unlocked from --.

Signed and Sealed this

Eleventh Day of June, 2002

*Attest:*

*Attesting Officer*

JAMES E. ROGAN
*Director of the United States Patent and Trademark Office*